United States Patent [19]

Seifert

[11] 3,941,114

[45] Mar. 2, 1976

[54] CYLINDER-CRANKCASE STRUCTURE OF CAST HOUSING ELEMENTS CONNECTED IN SERIES

[75] Inventor: Richard Seifert, Friedrichshafen, Germany

[73] Assignee: Motoren-und Turbinen-Union Friedrichshafen GmbH, Germany

[22] Filed: Nov. 27, 1973

[21] Appl. No.: 419,333

[30] Foreign Application Priority Data

Dec. 8, 1972 Germany ..... 2260142

[52] U.S. Cl. ..... 123/195 R; 123/195 H; 123/195 S

[51] Int. Cl.[2] ..... F02F 1/00

[58] Field of Search..... 123/195 R, 195 S, 195 H, 123/52 R, 55 R; 92/146

[56] References Cited

UNITED STATES PATENTS

| | | | |
|---|---|---|---|
| 2,416,045 | 2/1947 | Chapman | 123/195 R X |
| 2,740,303 | 4/1956 | Hoffman | 123/195 R |
| 2,838,038 | 6/1958 | Seifert et al. | 123/195 S |
| 3,768,252 | 10/1973 | Kubisch et al. | 123/195 H |
| 3,769,953 | 11/1973 | Kuhn | 123/195 R |

*Primary Examiner*—Charles J. Myhre
*Assistant Examiner*—William C. Anderson
*Attorney, Agent, or Firm*—Craig & Antonelli

[57] ABSTRACT

A cylinder-crankcase for a multi-cylinder internal combustion engine with a V-arrangement of the cylinders, which consists of welded-together cast housing elements that are connected in series in a building-block-like manner; each of the housing elements includes a cross wall with a bearing socket-half for a crankshaft bearing and two cylinder shells for each cylinder row, whereby the two cylinder rows are mutually offset by the width of a connecting rod bearing and the separating planes of the housing elements do not pass through the cylinder centers; the cross wall thereby includes an upper boundary which is substantially rectilinear but inclined with respect to the center cross plane of the housing element, as viewed in plan view, while imaginary lines starting from this boundary and extending in the neutral center surface of the cross wall in the direction toward the area of the bearing socket are substantially straight lines.

14 Claims, 6 Drawing Figures

CYLINDER-CRANKCASE STRUCTURE OF CASTHOUSING ELEMENTS CONNECTED IN SERIES

The present invention relates to a cylinder-crankcase for a multi-cylinder internal combustion engine with a V-arrangement of the cylinders, which is welded together of cast housing-elements connected in series one adjacent the other building-block-like, and each of the housingelements includes a cross wall with a bearing-socket-half for a crankshaft journal bearing and two cylinder shells for each cylinder row, whereby the two cylinder rows are mutually offset by the width of a connecting rod bearing and the separating planes of the housing-elements do not pass through the cylinder centers.

The cylinder-crankcase for internal combustion engines with a V-arrangement of the cylinders (so-called V-engines) have to be so reinforced by cross walls that the forces and stresses occurring in operation cannot cause any undue deformations of the housing. With V-engines whose cylinder rows are offset with respect to one another in order to be able to arrange the connecting rod bearings of oppositely disposed cylinders adjacent one another on the crankshaft, the vertical and right-angle arrangement of cross walls is not possible. The gaps between the cylinders into which the cross walls extend toward the outer walls, are no longer disposed opposite one another with this cylinder arrangement and the cylinder liners project into the crank space interfering with the formation of a plane wall configuration.

For this reason, the cross walls in the known cylinder-crankcase are more or less strongly angularly bent in their configuration in order to bridge the offset of the cylinder rows and to keep free the installation space for the cylinder liners. As a result of this non-uniform wall configuration, the forces engaging at the wall cause additional bending moments, whence relatively heavy wall thicknesses are required.

The present invention is therefore concerned with the task to provide a welded-together cylinder-crankcase whose housing-elements have each a cross wall reinforced in an optimum manner.

The underlying problems are solved according to the present invention in that the cross wall has an upper boundary which extends rectilinearly but at an inclination to the center cross plane of the housing-element, and that imaginary line starting from this boundary and extending in the neutral center surface of the cross wall in the direction toward the area of the bearing socket are straight lines.

In one embodiment according to the present invention, the imaginary straight lines starting from the upper boundary and extending in the neutral center surface of the cross wall, intersect in a point, namely the point of intersection of the median vertical perpendicular to the bearing axis.

In another embodiment according to the present invention, the imaginary straight lines starting from the upper boundary and extending in the neutral center surface of the cross wall, intersect the center cross plane of the housing-element along a circular arc about the bearing axis and the bearing axis itself.

In a further embodiment according to the present invention, the imaginary straight lines starting from the upper boundary which extend in the neutral surface of the cross wall parallel to one another, intersect the center cross plane of the housing-element along a horizontal straight line passing through the bearing axis.

According to a further feature of the present invention, the cross wall extends through the median vertical of the housing-element and passes in each case between the two adjacent cylinder shells of each cylinder row.

For the further reinforcement, ribs are arranged according to the present invention on the cross wall, which extend rectilinearly from reinforcements at the bearing socket for bearing bolts toward reinforcements for cylinder head bolts which are arranged between the adjacent cylinder shells of each row.

According to the present invention, a pair of ribs is arranged on each side of the cross wall for each cylinder shell and one rib each of a pair is coordinated to one of the two reinforcements at the bearing socket.

The advantages achieved by the present invention reside in particular in the fact that by reason of the rectilinear or nearly rectilinear configuration of the cross wall in the main force direction between the cylinder and crankshaft, an optimum reinforcement of the cylinder-crankcase is achieved, in that no bending moments can occur in the cross walls which result from the tensional stresses but only pure tensional forces can occur, which reduces the danger of uncontrolled housing deformations, and in that smaller wall thicknesses can be utilized as compared to the prior art construction, which results in a lower weight of the cylinder-crankcase and therewith in a lower specific weight of the internal combustion engine together with the known advantages resulting therefrom.

These and further objects, features and advantages of the present invention will become more apparent from the following description when taken in connection with the accompanying drawing which shows, for purposes of illustration only, several embodiments in accordance with the present invention, and wherein.

Figure 1:
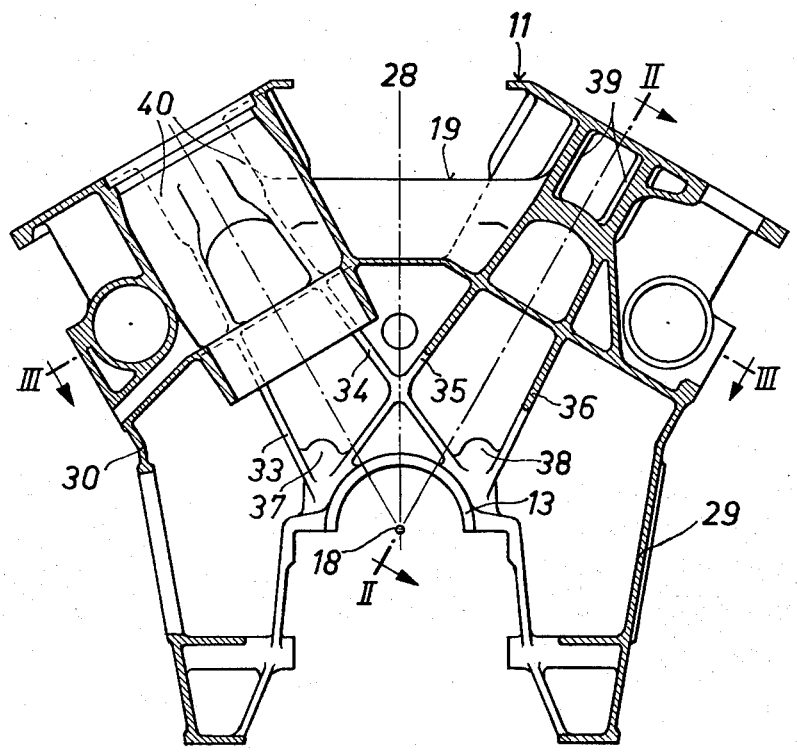
FIG. 1 is a vertical cross-sectional view through a housingelement in accordance with the present invention, taken along line I—I of FIG. 3.

Referring now to the drawing wherein like reference numerals are used throughout the various views to designate like parts, a welded-together cylinder-crankcase, which is not illustrated in detail in the drawing, for a multi-cylinder internal combustion engine with a V-arrangement of the cylinders, consists of several cast housing-elements generally designated by reference numeral 11 which are series-connected in a building-block-like manner. Each of the housing-elements 11 includes a cross wall 12 with a bearing socket half 13 for a crankshaft journal bearing and two cylinder shells 14, 15 and 16, 17 for each cylinder row.

Figure 2:
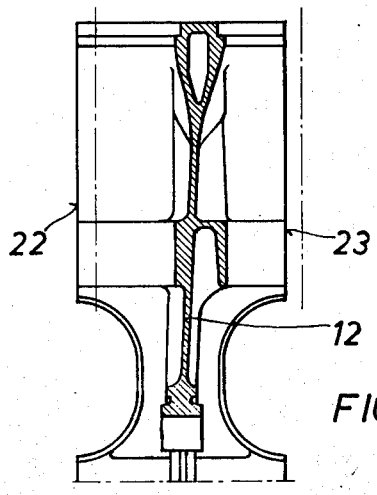
FIG. 2 is a longitudinal cross-sectional view of the housing element through the cylinder area taken along line II—II of FIG. 1.
Figure 3:
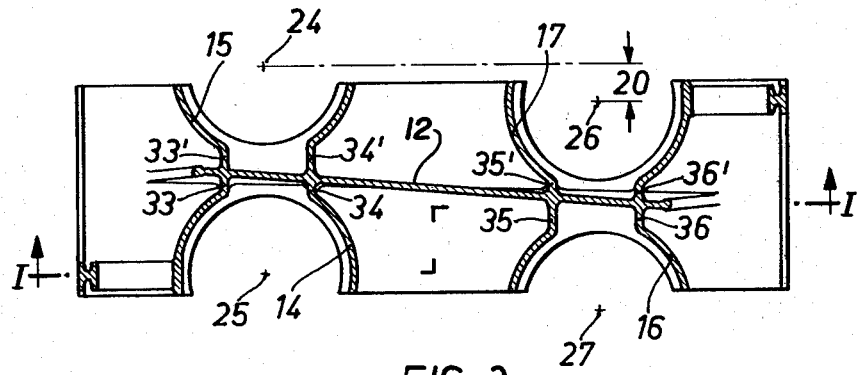
FIG. 3 is a horizontal cross-sectional view through the cylinder area of the housing element in accordance with the present invention, taken along line III—III of FIG. 1.

The cylinder rows are thereby offset with respect to one another by the width of a connecting rod bearing in order that the connecting rod bearings of oppositely disposed cylinders can be arranged adjacent one another on the crankshaft. For this reason, the separating planes 22 and 23 (FIG. 2) of the housing-elements also do not extend through the cylinder centers 24, 25, 26, 27 (FIG. 3).

In order to attain a wall configuration which is as planar as possible and as uniform as possible, notwithstanding the fact that the connecting lines of the cross wall 12 at the longitudinal walls 29 and 30 (FIG. 1) are no longer disposed opposite one another, the cross wall 12 includes an upper boundary 19 (FIG. 1) which, as viewed in plan view, extends rectilinearly but at an inclination to the center cross plane 21 (FIG. 4) of the housing-element 11. Imaginary lines 31 which start from this boundary 19 and extend in the neutral center surface of the cross wall in the direction toward the area of the bearing socket 13, are straight lines. In the various embodiments, this boundary 19 is represented as horizontal straight line. However, a curvature of the boundary 19 in the vertical direction, i.e., curved as viewed in side view is also within the scope and purview of this invention.

Figure 4:
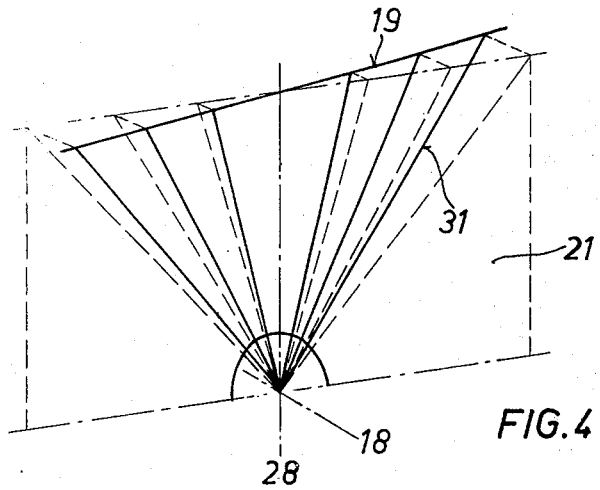
FIGS. 4 to 6 are schematic perspective views of various embodiments of the cross wall which can be used with the present invention.

In one possible embodiment of the cross wall 12, the imaginary lines 31 which start from the upper boundary 19 and extend in the neutral center surface of the cross wall 12, intersect in a point, and more particularly in the point of intersection of the vertical center line or median perpendicular 28 with the bearing axis 18 (FIG. 4).

Figure 5:
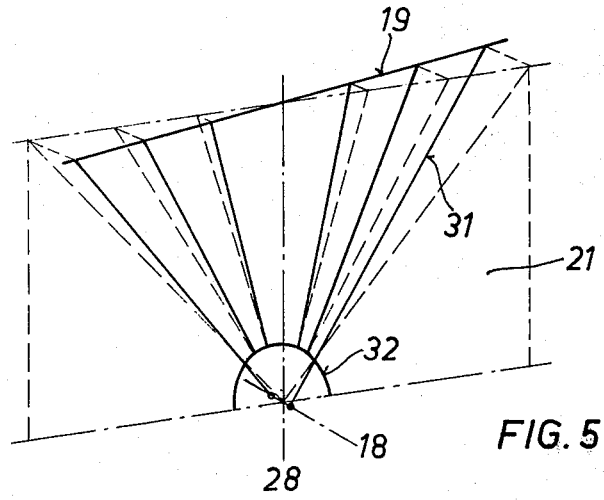

In another embodiment of the cross wall 12, the imaginary straight lines 31 which start from the upper boundary 19 and extend in the neutral center surface of the cross wall 12, intersect the center cross plane 21 of the housing-element 11 along a circular arc 32 extending about the bearing axis 18 as well as the bearing axis 18 itself (FIG. 5). This circular arc 32 is realized with a radius which corresponds appropriately to approximately half the diameter of the bearing bore. It is achieved thereby that the cross wall 12 adjoins the bearing socket half 13 over the entire circumference thereof axially or concentrically and in the center with respect to the bearing socket width, that the force introduction takes place particularly uniformly and therewith the form-rigidity of the bearing socket half 13 is improved.

Figure 6:
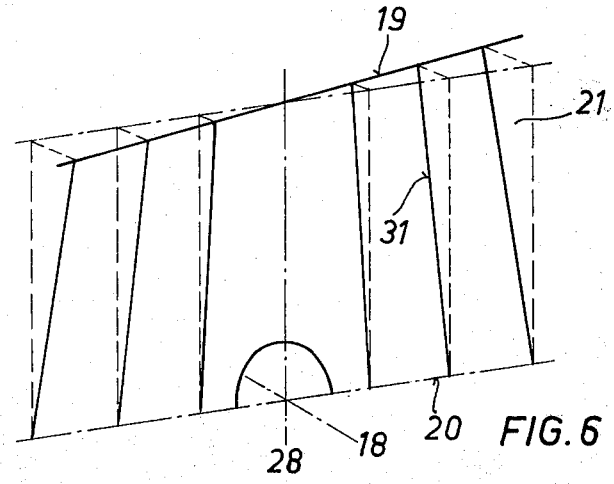

In a further embodiment of the cross wall 12, the imaginary lines 31 which start from the upper boundary 19 and extend parallelly in the neutral center surface of the cross wall 12, intersect the center cross plane 21 of the housing-element 11 on a horizontal straight line 20 extending through the bearing axis 18 (FIG. 6).

The cross wall 12 extends through the vertical center line or median perpendicular 28 of the housing-element 11 (FIG. 1) and passes in each case between the two adjacent cylinder shells 14, 15 and 16, 17 of each cylinder row (FIG. 3), whereby the cooling water spaces of the individual cylinders are separated from one another.

It is advantageous with this arrangement of the cross wall 12 that by reason of the rectilinear configuration of the cross walls or nearly rectilinear configuration of the cross walls in the embodiment of FIG. 6, which are rectilinear or nearly rectilinear in the main force direction between the cylinder and the crankshaft, an optimum reinforcement of the cylindercrankcase is achieved. No bending moments occur any longer in the cross walls which result from the tensile stresses but only pure tensional forces can become effective, whence the danger of uncontrolled housing deformations is reduced. Consequently, it is possible as compared to prior art constructions to utilize smaller wall thicknesses in the present invention, which produces a smaller weight of the cylinder-crankcase and therewith a smaller specific weight of the internal combustion engine with the known advantages resulting therefrom.

For the purpose of further reinforcement, ribs 33, 34; 33′, 34′; 35, 36; 35′, 36′ (FIGS. 1 and 3) are arranged according to the present invention on the cross wall 12; these ribs 33, 34; 33′, 34′; 35, 36; 35′, 36′; extend rectilinearly from reinforcements 37 and 38 (FIG. 1) at the bearing socket 13 for bearing bolts to reinforcements 39 and 40 for cylinder head bolts which are arranged between adjacent cylinder shells 14, 15 and 16, 17 of each row. One pair of ribs 33, 34; 33′, 34′; 35, 36; 35′, 36′ is thereby arranged on each side of the cross wall 12 for each cylinder shell 14, 15, 16, 17 and one rib each of a pair is coordinated to one of the two reinforcements at the bearing socket 13.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A cylinder-crankcase structure for a multi-cylinder internal combustion engine with a V-arrangement of the cylinders which is welded together of cast housing-elements that are connected in series with each other in a building block manner, each of the housing-elements including a unitary cross wall means having a bearing socket half for a crankshaft bearing and two cylinder shell means for each cylinder row, the two cylinder rows being offset with respect to one another substantially by the width of a connecting rod bearing and the separating plane of the housing-elements being offset with respect to the cylinder centers, characterized in that the cross wall means includes an upper boundary which, at least in plan view, extends substantially rectilinearly and at an inclination to the center cross plane of a respective housing element, and in that imaginary lines starting from said upper boundary and extending substantially in a neutral center surface of the cross wall means in the direction toward the area of the bearing socket are straight lines.

2. A cylinder-crankcase structure according to claim 1, characterized in that said imaginary lines intersect in a point.

3. A cylinder-crankcase (structure) according to claim 2, characterized in that said point is the point of intersection of a vertical line intersecting and perpendicular to the bearing axis of the crankshaft bearing.

4. A cylinder-crankcase structure according to claim 1, characterized in that said imaginary lines intersect the center cross plane of a housing element along a substantially circular arc about the bearing axis as well as said bearing axis.

5. A cylinder-crankcase structure according to claim 1, characterized in that said imaginary lines extend substantially parallel in the neutral center surface of the cross wall means and intersect the center cross plane of a respective housing-element on a substantially horizontal straight line extending through the bearing axis.

6. A cylinder-crankcase structure according to claim 1, characterized in that the cross wall means extends through the vertical center line of a respective housing-element and passes through between the two adjacent cylinder shell means of each cylinder row.

7. A cylinder-crankcase structure according to claim 6, characterized in that rib means are provided on the cross wall means which extend substantially rectilinearly from reinforcements at the bearing socket means for bearing bolts to reinforcements for cylinder head bolts which are arranged between adjacent cylinder shell means of each row.

8. A cylinder-crankcase structure according to claim 7, characterized in that one pair of rib means each is arranged for each cylinder shell means on each side of the cross wall means, one rib each of a respective pair being coordinated to one of the two reinforcements at the bearing socket means.

9. A cylinder-crankcase structure according to claim 8, characterized in that said imaginary lines intersect in a point.

10. A cylinder-crankcase structure according to claim 9, characterized in that said point is the point of intersection of a vertical line intersecting and perpendicular to the bearing axis of the crankshaft bearing.

11. A cylinder-crankcase structure according to claim 8, characterized in that said imaginary lines intersect the center cross plane of a housing element along a substantially circular arc about the bearing axis as well as said bearing axis.

12. A cylinder-crankcase structure according to claim 8, characterized in that said imaginary lines extend substantially parallel in the neutral center surface of the cross wall means and intersect the center cross plane of a respective housing-element on a substantially horizontal straight line extending through the bearing axis.

13. A cylinder-crankcase structure according to claim 1, characterized in that rib means are provided on the cross wall means which extend substantially rectilinearly from reinforcements at the bearing socket means for bearing bolts to reinforcements for cylinder head bolts which are arranged between adjacent cylinder shell means of each row.

14. A cylinder-crankcase structure according to claim 13, characterized in that one pair of rib means each is arranged for each cylinder shell means on each side of the cross wall means, one rib each of a respective pair being coordinated to one of the two reinforcements at the bearing socket means.

* * * * *